US006126254A

United States Patent [19]

Maglione

[11] Patent Number: 6,126,254

[45] Date of Patent: Oct. 3, 2000

[54] COLLAPSIBLE PAPERBOARD DISPLAY

[76] Inventor: Stephen Thomas Maglione, 71 Baltursol Way, Far Hills, N.J. 07931

[21] Appl. No.: 09/449,785

[22] Filed: Nov. 26, 1999

Related U.S. Application Data

[60] Provisional application No. 60/154,711, Sep. 18, 1999.

[51] Int. Cl.[7] ..... A47B 43/02

[52] U.S. Cl. ..... 312/259; 248/174

[58] Field of Search ..... 312/257.1, 258, 312/259, 261; 40/539; 248/174; 108/162, 180; 446/478, 482, 488

[56] References Cited

U.S. PATENT DOCUMENTS

| | | | |
|---|---|---|---|
| 2,324,232 | 7/1943 | Pantalone | 248/174 X |
| 3,307,767 | 3/1967 | Humphrey et al. | 312/259 X |
| 4,942,830 | 7/1990 | Macaluso et al. | 312/259 X |
| 5,143,431 | 9/1992 | Udell | 312/259 |
| 5,458,411 | 10/1995 | Moss | 312/259 |
| 5,826,732 | 10/1998 | Ragsdale | 248/174 X |
| 5,904,410 | 5/1999 | Davies | 312/259 |

*Primary Examiner*—Peter M. Cuomo
*Assistant Examiner*—James O. Hansen

[57] ABSTRACT

A counter display for cosmetics includes a substantially one piece corrugated paperboard comprising a rear wall, sidewalls having inner and outer side wall panels, top wall panel and bottom wall panel attached to each other at foldlines. A top section is formed with a top section front wall panel and with flaps that fold against the side and front panels. A bottom section is formed with further flaps and panels that form a bottom shelf and a bottom front wall panel. The bottom section forms a shelf that is locked to a slot in the rear wall with a tab. Shelves have flaps that are locked to the side walls between the inner and outer side wall panels. The upper side wall inner and outer panels lock top wall flaps in place. The inner panels are locked in place by tabs and slots in the rear wall.

22 Claims, 7 Drawing Sheets

COLLAPSIBLE PAPERBOARD DISPLAY

This application claims priority of prior provisional application Ser. No. 60/154,711 filed Sep. 18, 1999.

This invention relates to displays for displaying articles, and more particularly, to counter displays for displaying articles on point of sale counters.

Paperboard displays are widely available in many shapes, sizes and configurations. Each display is arranged to accommodate a given need.

A need is seen for a substantially one piece display formed of paperboard that readily assembles into an aesthetically pleasing display unit and can be formed from one sheet of material. Such a display is especially suitable for counters for pleasing presentation of relatively small articles.

A collapsible paperboard article display according to the present invention comprises a rear wall. First and second side walls are secured to the rear wall and a top wall is coupled to the rear wall, the side walls and rear wall forming a display chamber. An upper front wall is coupled top wall and a lower front wall is coupled to the rear wall. A lower shelf is coupled to the lower front wall and rear wall and forms a bottom wall of the chamber. At least one further shelf is secured to the side walls in the chamber.

In one aspect the top wall, the side walls, the rear wall, the upper and lower front walls and the lower shelf comprise an integral one piece paperboard sheet.

In a further aspect, the rear wall has opposite edges, the side walls each including an outer panel and a plurality of inner panels, each outer panel being hinged to the rear wall at a corresponding opposite rear wall edge and forming an outer wall of a corresponding side wall, the plurality of inner panels being hinged to the corresponding outer panel forming an inner wall of the corresponding side wall and located in the chamber, the further shelf including a shelf portion defining opposing lateral first and second side edges and first and second flaps each at a different opposing shelf side edge, the first flap being located between the outer panel and one of the inner panels of the first side wall and the second flap being located between the outer panel and one of the inner panels of the second side wall.

The further shelf preferably comprises top and bottom juxtaposed shelf panels hinged together at a shelf front edge, further including the first flap at each shelf panel first side edge and the second flap at each shelf panel second side edge. Preferably the shelf is an integral one piece paper board sheet.

In a further aspect, a bottom wall is included, the bottom wall being hinged to the rear wall, the lower front wall being hinged to the bottom wall and the lower shelf being hinged to the lower front wall.

In a further aspect, the rear wall has opposing edges, the side walls have a front edge distal the rear wall, each side wall comprising outer and inner panels hinged at the front edge, the outer panel being hinged to the rear wall at a rear wall edge, the bottom wall having opposing edges each at a different side wall, a further panel hinged to the bottom wall at each the bottom wall edges, the further panel being located between the outer and inner panels.

In a still further aspect, the side wall inner panels, lower shelf and rear wall include cooperating tab and slot means for securing the lower shelf to the rear wall and the inner panels in the chamber juxtaposed with the outer panels.

The side wall outer panel of each side wall preferably includes a tab juxtaposed with the lower front wall and locked in place by the lower front wall and a corresponding bottom wall further panel.

In a further aspect, the display further includes an upper inner panel hinged to the upper front wall and located in the chamber, the upper front wall being hinged to the top wall and the top wall being hinged to the rear wall, the upper inner panel having opposing edges adjacent to and corresponding to a different side wall, a further panel hinged to each of the edges, the side walls each including an outer side panel and an inner side panel, the further panel at each edge being positioned between the outer and inner side panels.

Preferably, included are a plurality of the further shelves, the side walls comprising outer and inner panels, each of the further shelves including flaps juxtaposed with each the side walls and located between the outer and inner panels. In a further aspect, the shelves each comprise lower and upper shelf panels hinged at a common foldline, each shelf panel having opposing edges, a flap being located at each the opposing shelf panel edges.

IN THE DRAWING

Figure 1:
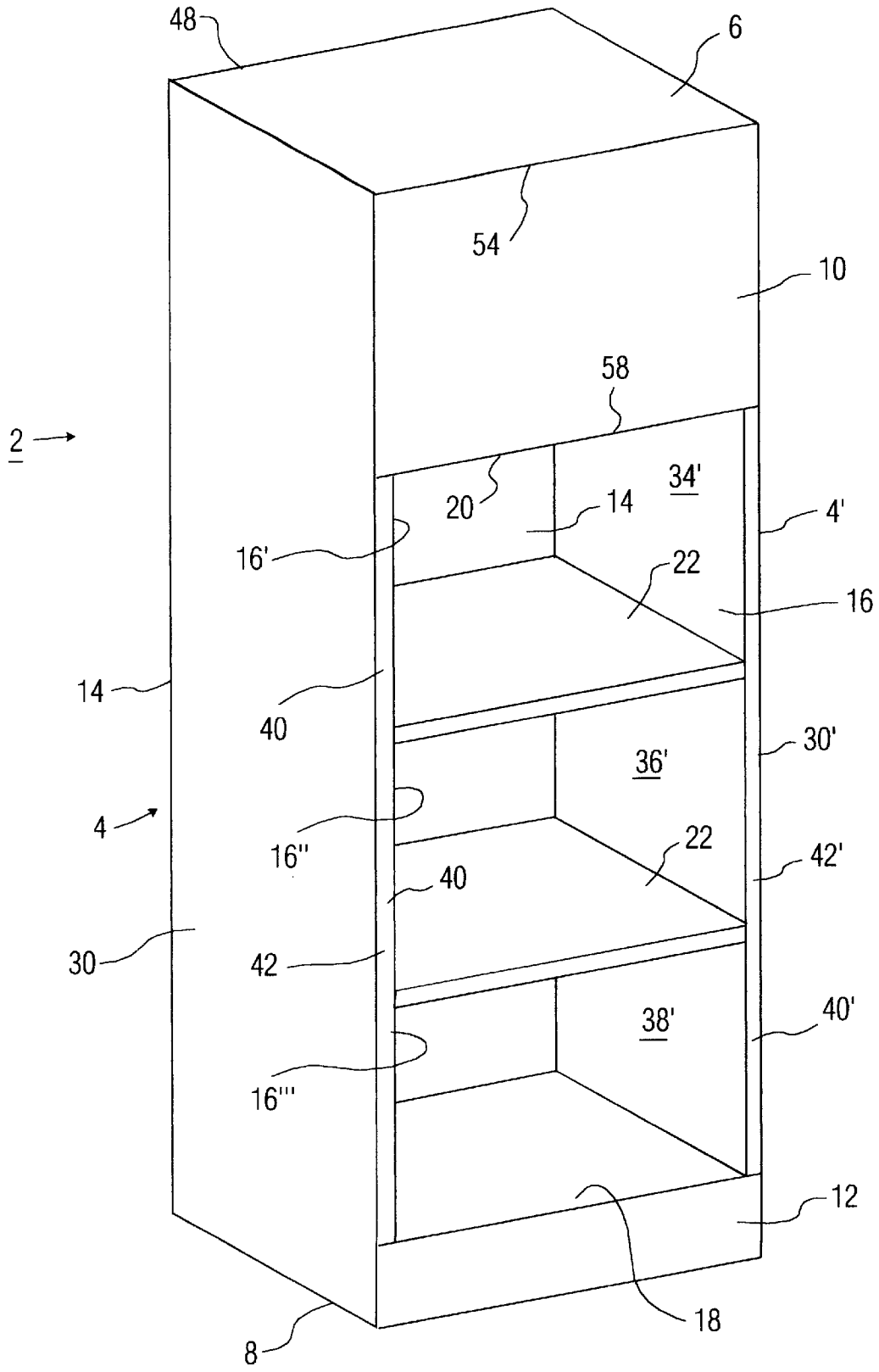
FIG. 1 is an isometric view of a counter display according to an embodiment of the present invention.
Figure 3A:
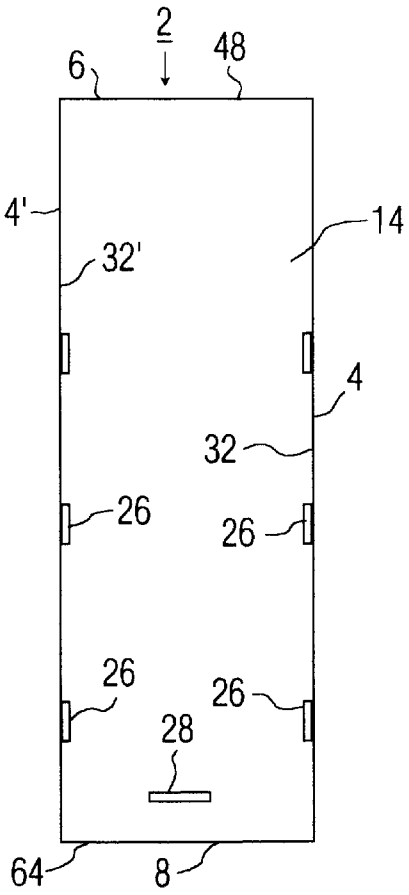
FIG. 3 is a side elevation view, partially in section, of the display of FIG. 2 taken along lines 3—3.
Figure 3:
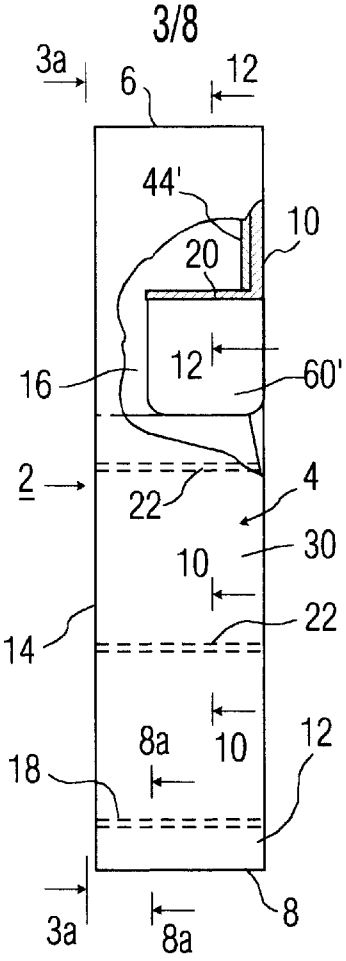
Figure 2:
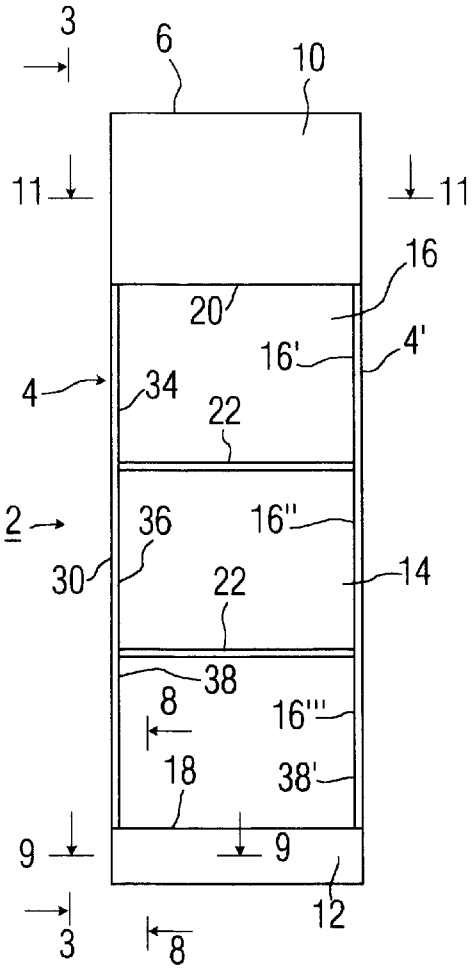
FIG. 2 is a front view of the display of FIG. 1.
Figure 4:
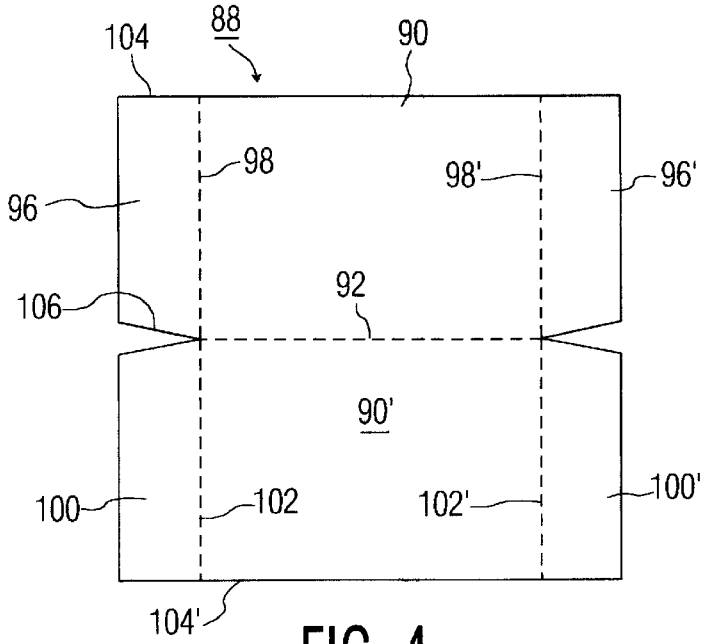
Figure 5:
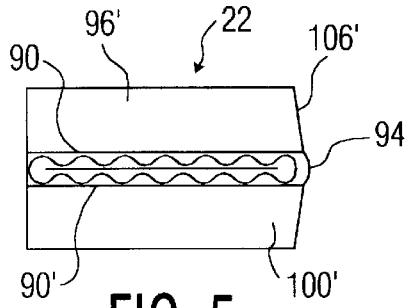
Figure 6:
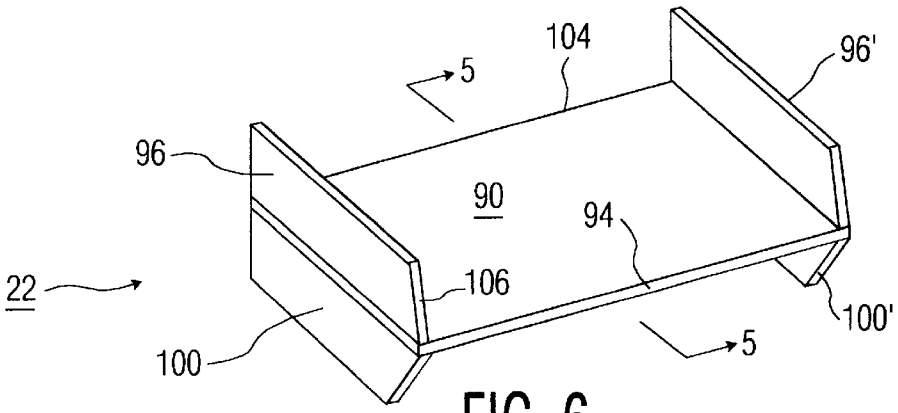
Figure 7:
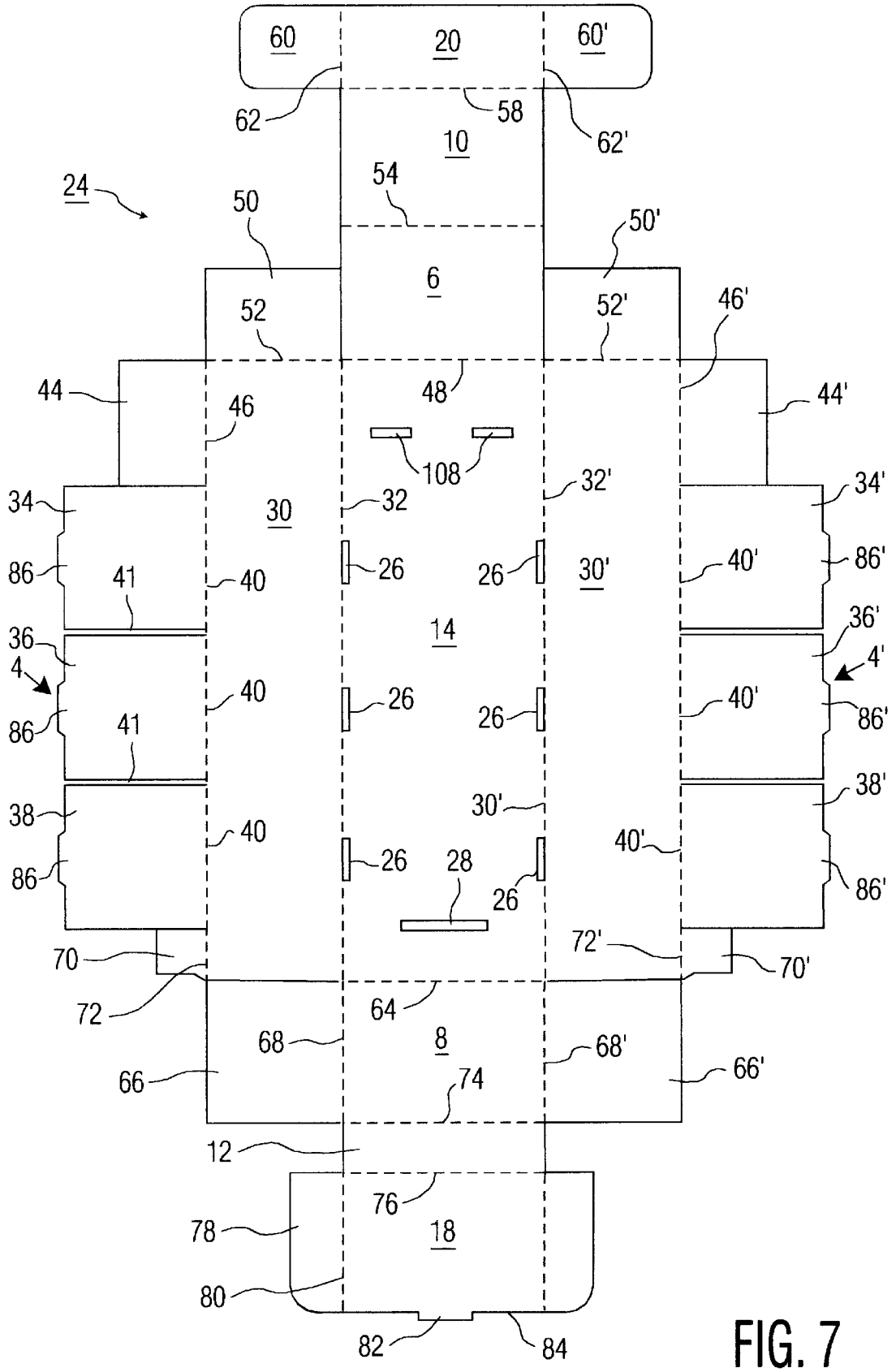
Figure 8:
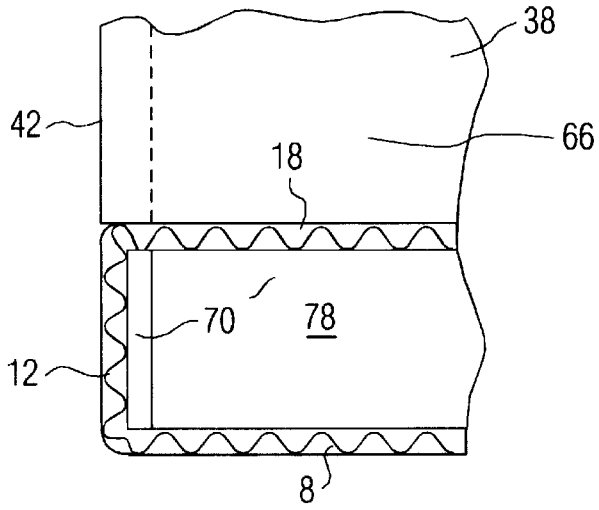
Figure 8A:
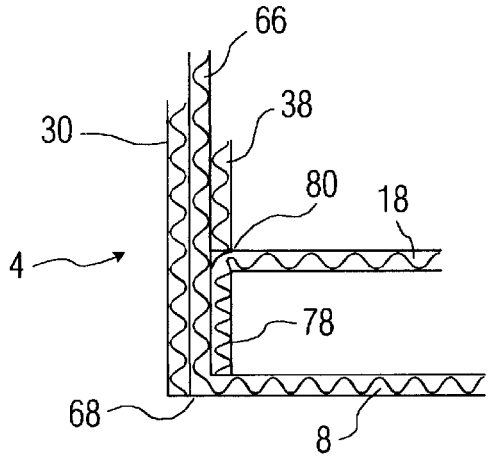

FIG. 3*a* is a rear elevation view of the display of FIG. 1 taken along lines 3*a*—3*a* of FIG. 3;

FIG. 4 is a plan view of a blank used to form a shelf in the embodiment of FIG. 1;

FIG. 5 is a sectional side elevation view through a shelf folded for assembly to the mating frame structure of the display taken along lines 5—5 of FIG. 6;

FIG. 6 is an isometric view of the shelf blank of FIG. 4 folded for assembly into the mating frame structure;

FIG. 7 is a plan view of a blank used to make the frame of the display of FIGS. 1–3;

FIG. 8 is a sectional view of the display of FIG. 2 taken along lines 8—8;

FIG. 8*a* is a sectional view of the display of FIG. 3 taken along lines 8*a*—8*a;*

Figure 9:
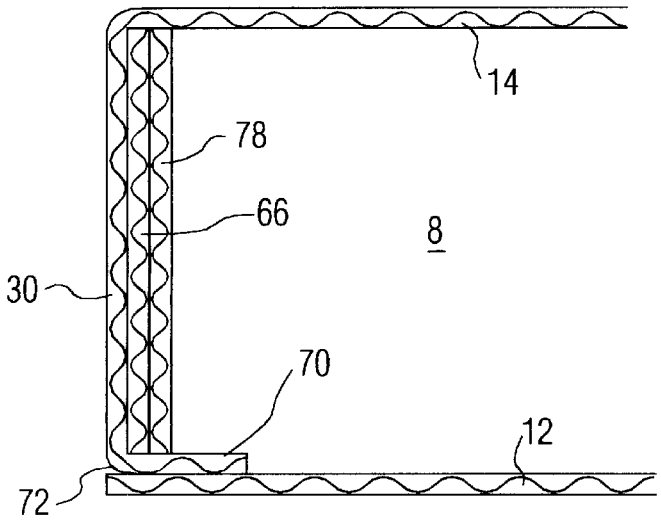
Figure 10:
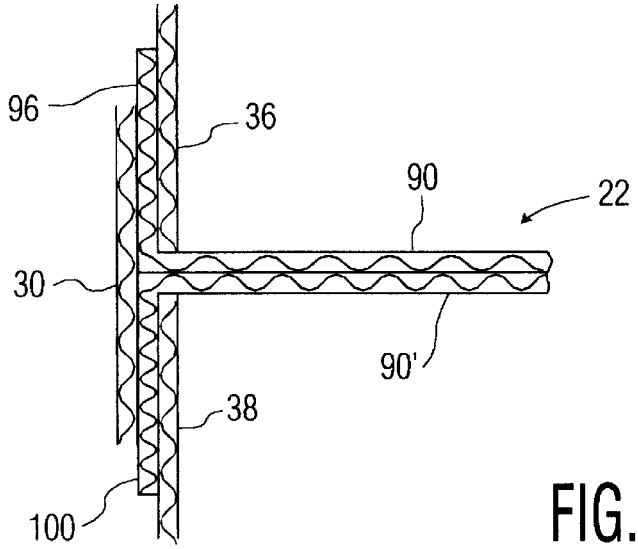
Figure 11:
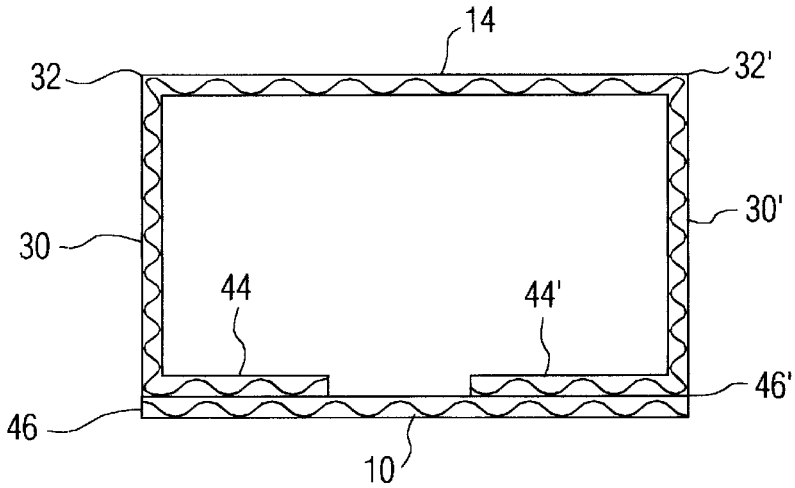
Figure 12:
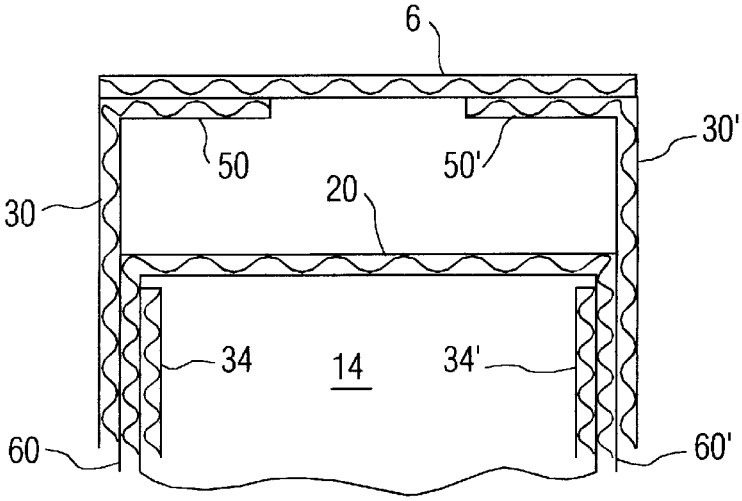
Figure 13:
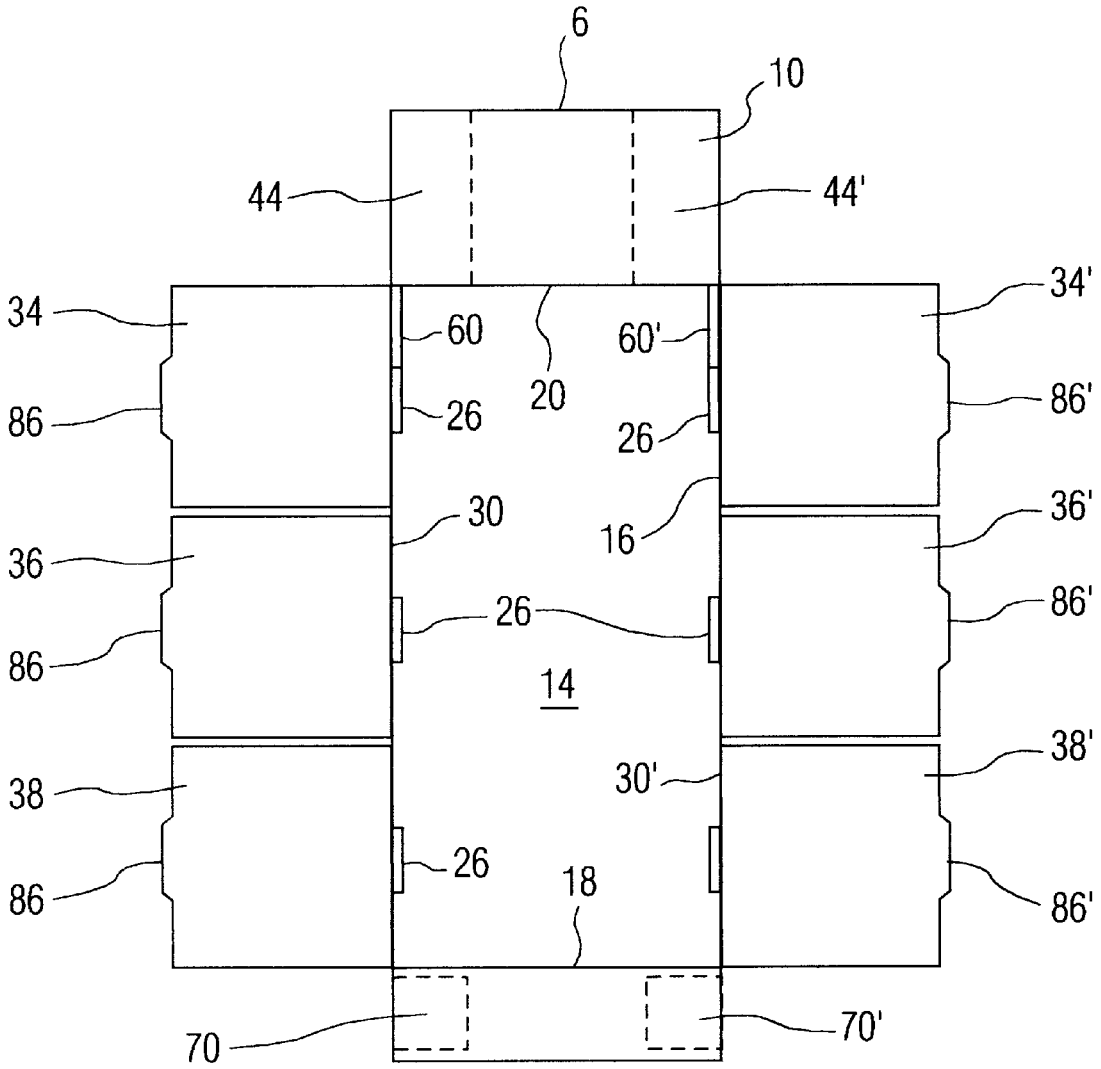

FIG. 9 is a sectional view of the display of FIG. 2 taken along lines 9—9;

FIG. 10 is a sectional fragmented view of the display of FIG. 3 taken along lines 10—10;

FIG. 11 is a sectional view of the display of FIG. 2 taken along lines 11—11;

FIG. 12 is a sectional view of the display of FIG. 3 taken along lines 12—12; and FIG. 13 is a front elevation view of the display of the present invention partially assembled prior to final assembly of the FIG. 1 embodiment.

In FIGS. 1–3*a,* display 2 comprises two opposing mirror image side walls 4, 4', a top wall 6, a bottom wall 8, upper and lower front panel walls 10 and 12, respectively, and a rear wall 14. All of the foregoing are formed of one piece preferably corrugated paperboard. Non-corrugated paperboard may also be utilized. The side and rear walls form a display chamber 16. The chamber 16 is further formed by a lower shelf 18 and an upper interior panel 20, FIG. 3. Two identical shelves 22 are located in the chamber 16 and divide it into substantially equal subchambers 16', 16" and 16'". The display 2 may have a height of about 19 inches, a width of about 6 inches and a depth of about 4 inches. Of course, the scale of the display may be changed as desired. Except for the shelves 22 all of the remaining elements of the display 2 forming a housing frame are formed one piece from a single blank of paperboard.

In FIG. 7, blank 24 forms all of the walls and panels of the display 2 except for the shelves 22. Blank 24 has a central panel forming rear wall 14. A plurality of slots 26 and 28 are formed in the rear wall 14 at foldlines 32 for receiving assembly tabs 86 and 82, FIG. 7, of the various panels as will be explained.

In blank 24, dashed lines represent foldlines forming hinges and solid lines are through cuts through the sheet material. Side wall 4 is identical to side wall 4' and is in mirror image relation thereto. The same reference numerals primed and unprimed represent the same elements in mirror image relation in the blank 24. Representative wall 4 comprises an outer wall panel 30 connected to rear wall by foldline 32. Slots 26 are on foldlines 32, 32' as shown.

Inner side wall 4 panels 34, 36 and 38 are spaced from each other by a gap 41, extend laterally from panel 30 and are preferably identical in this embodiment and are connected to outer panel 30 by foldlines 40. Foldlines 40 lie on the same line forming the outer edge 42, FIG. 1, of the display 2 wall 4 when the panels 34, 36 and 38 are folded at the foldlines 40.

A flap panel 44 is connected to the panel 30 along foldline 46 which is common with foldlines 40. Top wall 6 is connected to rear wall 14 by foldline 48. Flap panel 50 is connected to panel 30 by foldline 52 normal to foldlines 40, 46. Top front panel 10 is connected to top wall 6 by foldline 54. Front interior panel 20 is connected to top front panel 10 by foldline 58. A side wall flap panel 60 is connected to flap panel 20 by foldline 62.

At the bottom of the blank, bottom wall 8 is connected to rear wall 14 by foldline 64. Flap panel 66 is connected to wall 8 by foldline 68. A lateral extending tab 70 is connected to outer wall panel 30 by foldline 72 which is coextensive with foldlines 40, 46. Bottom front wall panel 12 is connected to bottom wall 8 by foldline 74. Bottom shelf 18 is connected to front panel 12 by foldline 76. Flap 78 extends laterally from shelf 18 and is connected to shelf 18 by foldline 80. A locking tab 82 extends from the free edge 84 of shelf 18 distal foldline 76. Tab 82 mates in slot 28 in rear wall 14.

Locking tabs 86 extend laterally from the free edges of each of side wall panels 34, 36 and 38. Tabs 86 mate in a corresponding one of slots 26.

In FIGS. 4–6, shelf 22 is formed of a blank 88, FIG. 4. In FIG. 4, shelf blank 88 comprises two mirror image identical shelf panels 90, 90' joined by foldline 92. Foldline 92 forms the front edge 94 of the shelf 22. Panel 90 has two mirror image opposite flaps 96, 96' connected thereto by foldlines 98, 98', respectively. Panel 90' also has two mirror image opposite flaps 100, 100' connected thereto by foldlines 102, 102', flaps 98 and 100 being identical and mirror images. Representative flaps 96, 96' and panel 90 have an edge 104. Flap 96 has an edge 106 inclined to foldline 92 which edge is at the front and interior of the display 2, FIG. 1, adjacent to front edge 42. Flap 100 has a similar mirror image inclined edge which also is at and interior of front edge 42 of the display.

To assemble the display 2, FIG. 7, the panels 30 and 30' are folded at respective foldlines 32 and 32', FIG. 7, at right angles to rear wall 14. The panels 6, 10 and 20 at the top are folded at right angles relative to each other at their respective foldlines, FIGS. 11 and 12. This folding places panel 20 beneath and spaced from top wall panel 6 and parallel to it. The flaps 60 and 60' are bent at right angles relative to panel 20 and overlie panels 30 and 30', FIGS. 12 and 13. The flaps 60, 60' in this orientation depend downwardly in the assembled display. The flaps 44 and 44', FIG. 11, are folded at right angles at foldlines 46, 46' and placed interior of and overlying the front wall panel 10.

In FIG. 7, the bottom shelf 18 is folded at foldline 76, and the front bottom panel is folded at a right angle at foldline 74. At the same time flaps 66 and 66' are folded at their foldlines and are juxtaposed interior of the outer side wall panels 30, 30', FIG. 9. The tabs 70 are folded interior of and overlie the front bottom wall panel 12. The tab 82 is locked in slot 28. This produces the intermediate assembled structure of FIG. 13.

The lower interior side wall panels 38 and 38' are then folded interior of and overlying the outer panels 30, 30', respectively. Their tabs 86 and 86' are then engaged with the corresponding slots 26 in the rear wall 14 locking the panels 38 and 38' in place forming the interior walls of the subchamber 16''', FIG. 1.

At this time a shelf 22, FIG. 6, is assembled. The flaps 100, 100' are inserted between the respective interior panels 38, 38' and exterior panels 30 and 30', FIG. 10, with their inclined edges facing forward to the open front of the display but interior of and at the edges 42, 42'. At this time the panels 36 and 36', FIG. 13, are folded into the chamber 16 and their tabs 86 locked into corresponding slots 26. Panels 36 and 36' are then folded over the shelf 22 upper flaps 96, 96' (FIG. 6) locking the shelf 22 in place. This action sandwiches the shelf flaps between the interior panels 38, 38' and exterior side wall panels 30, 30'.

In similar fashion, the next upper shelf 22 is installed. Its lower flaps 100, 100' are inserted between the inner and outer side wall panels 36, 30 and 36', 30', respectively, FIG. 13. The upper interior panels 34 and 34', FIG. 13, are then folded interior of the chamber 16 and their tabs 86 locked to the corresponding slots 26. This locks the shelves 22 in place and the flaps 60 and 60' in place. The panels 34 and 34' overlie the flaps 60 and 60'. The panels 34, 34' also overlie the top section panels 60, 60', locking them in place.

The entire structure has clean lines and no protruding tabs or flaps showing from the front forming an aesthetically pleasing appearance. Appropriate indicia and printing is applied to the exposed panels to provide a finished appearance. The exterior of the paperboard sheets is provided with a finished paper for receiving such indicia.

A pair of slots 108, FIG. 7, may be provided the rear wall upper portion for hanging the display if desired.

It will occur to one of ordinary skill that modifications may be made to the disclosed embodiments without departing from the scope of the invention as defined in the appended claims. The disclosed embodiments are given by way of illustration and not limitation. For example, the number of tabs, the number of shelves, the relative size of the various panels to each other and the over all appearance may differ in different embodiments. While the tabs on the shelves are shown continuous, they may be discontinuous

What is claimed is:

1. A collapsible paperboard article display comprising:

a rear wall;

first and second side walls secured to the rear wall;

a top outer wall coupled to the rear wall;

said side walls, outer top and rear wall forming and enclosing a display chamber on three sides;

an upper front wall coupled to the top outer wall;

an inner top wall coupled to the upper front wall distal the top outer wall and forming an inner top wall of at least a portion of the chamber, the inner and outer top walls being juxtaposed in spaced relation;

a lower front wall coupled to the rear wall;

a lower shelf coupled to the lower front wall juxtaposed with the top walls and forming a bottom wall of the chamber; and at least one further shelf secured to said side walls in said chamber.

2. The display of claim 1 wherein said top wall, said side walls, said rear wall, said upper and lower front walls and said lower shelf comprise an integral one piece paperboard sheet.

3. The display of claim 1 wherein the rear wall has opposite edges, the side walls each including an outer panel and a plurality of inner panels, each outer panel being hinged to the rear wall at a corresponding opposite rear wall edge and forming an outer wall of a corresponding side wall, the plurality of inner panels being hinged to the corresponding outer panel forming an inner wall of the corresponding side wall and located in said chamber, said further shelf including a shelf portion defining opposing lateral first and second side edges and first and second flaps each at a different opposing shelf side edge, the first flap being located between the outer panel and one of said inner panels of the first side wall and the second flap being located between the outer panel and one of said inner panels of the second side wall.

4. The display of claim 3 wherein the further shelf comprises top and bottom juxtaposed shelf panels hinged together at a shelf front edge, further including the first flap at each shelf panel first side edge and the second flap at each shelf panel second side edge.

5. The display of claim 4 wherein the shelf is an integral one piece paper board sheet.

6. The display of claim 1 further including a display bottom wall, the display bottom wall being hinged to the rear wall, the lower front wall being hinged to the bottom wall and the lower shelf being hinged to the lower front wall.

7. The display of claim 6 wherein the rear wall has opposing edges, the side walls have a front edge distal the rear wall, each side wall comprising outer and inner panels hinged at the front edge, the outer panel being hinged to the rear wall at a rear wall edge, the bottom wall having opposing edges each at a different side wall, a further panel hinged to the bottom wall at each said bottom wall edges, the further panel being located between said outer and inner panels.

8. The display of claim 7 wherein the side wall inner panels, lower shelf and rear wall including cooperating tab and slot means for securing the lower shelf to the rear wall and the inner panels in said chamber juxtaposed with the outer panels.

9. The display of claim 7 wherein the side wall outer panel of each side wall includes a tab juxtaposed with the lower front wall and locked in place by the lower front wall and a corresponding bottom wall further panel.

10. The display of claim 1 wherein the inner top wall is hinged to the upper front wall and located in said chamber, the upper front wall being hinged to the top wall and the top wall being hinged to the rear wall, the upper inner top wall having opposing edges adjacent to and corresponding to a different side wall, a further panel hinged to each of said edges, said side walls each including an outer side panel and an inner side panel, the further panel at each edge being positioned between the outer and inner side panels.

11. The display of claim 1 including a plurality of said further shelves, the side walls comprising outer and inner panels, each of the further shelves including flaps juxtaposed with each said side walls and located between the outer and inner panels.

12. The display of claim 11 wherein the shelves each comprise lower and upper shelf panels hinged at a common foldline, each shelf panel having opposing edges, a flap being located at each said opposing shelf panel edges.

13. A collapsible paperboard article display comprising:

a rear wall;

first and second side walls each hinged to the rear wall, each side wall comprising an outer panel and a plurality of inner panels, the inner panels hinged to the outer panels distal the rear wall;

a top wall hinged to the rear wall;

said side walls, top wall and rear wall forming a display chamber;

an upper front wall hinged to the top wall;

an upper chamber wall located in the chamber and hinged to the upper front wall juxtaposed with the top wall and juxtaposed with a portion of the chamber;

an upper chamber wall flap panel hinged to the upper chamber wall at opposite edges of the upper chamber wall and juxtaposed between a side wall outer panel and an inner panel;

a bottom wall hinged to the rear wall;

a lower front wall hinged to the bottom wall;

a lower shelf hinged to lower front wall and forming a bottom wall of the chamber juxtaposed with the top wall; and at least one further shelf secured to said side walls in said chamber, said one further shelf having opposite lateral side edges, a flap extending from each lateral side edge and positioned between a side wall outer panel and at least one side wall inner panel.

14. The display of claim 13 including a plurality of tab means for securing a plurality of the side wall inner panels to the rear wall and the lower shelf to the rear wall.

15. The display of claim 13 including a tab secured to each side wall outer panel juxtaposed with the lower front wall between the lower shelf and bottom wall.

16. The display of claim 13 wherein each side wall has a first upper flap panel juxtaposed with the top wall in the chamber and a second upper flap panel juxtaposed with the upper front wall in the chamber.

17. The display of claim 13 including a plurality of said further shelves, each further shelf comprising upper and lower juxtaposed panels hinged at a shelf front edge distal the rear wall, each shelf panel having said flap.

18. A collapsible paperboard article display comprising:

a rear wall;

first and second side walls secured to the rear wall;

a top wall coupled to the rear wall;

said side walls and rear wall forming a display chamber;

an upper front wall coupled to the top wall;

a lower front wall;

a lower shelf coupled to the lower front wall and forming a bottom wall of the chamber;

at least one further shelf secured to said side walls in said chamber; and a bottom wall, the bottom wall being hinged to the rear wall, the lower front wall being hinged to the bottom wall and the lower shelf being hinged to the lower front wall;

the rear wall having opposing edges, the side walls having a front edge distal the rear wall, each side wall comprising outer and inner panels hinged at the front edge, the outer panel being hinged to the rear wall at a rear wall edge, the bottom wall having opposing edges each at a different side wall, a further panel hinged to the bottom wall at each said bottom wall edges, the further panel being located between said outer and inner panels;

the side wall inner panels, lower shelf and rear wall including cooperating tab and slot means for securing the lower shelf to the rear wall and the inner panels in said chamber juxtaposed with the outer panels.

19. A collapsible paperboard article display comprising:

a rear wall;

first and second side walls secured to the rear wall;

a top wall coupled to the rear wall;

said side walls and rear wall forming a display chamber;

an upper front wall coupled to the top wall;

a lower front wall coupled to the rear wall;

a lower shelf coupled to the lower front wall and forming a bottom wall of the chamber;

at least one further shelf secured to said side walls in said chamber; and a bottom wall, the bottom wall being hinged to the rear wall, the lower front wall being hinged to the bottom wall and the lower shelf being hinged to the lower front wall;

the rear wall having opposing edges, the side walls having a front edge distal the rear wall, each side wall comprising outer and inner panels hinged at the front edge, the outer panel being hinged to the rear wall at a rear wall edge, the bottom wall having opposing edges each at a different side wall, a further panel hinged to the bottom wall at each said bottom wall edges, the further panel being located between said outer and inner panels;

the side wall outer panel of each side wall including a tab juxtaposed with the lower front wall and locked in place by the lower front wall and a corresponding bottom wall further panel.

20. A collapsible paperboard article display comprising:

a rear wall;

first and second side walls each hinged to the rear wall, each side wall comprising an outer panel and a plurality of inner panels, the inner panels hinged to the outer panels distal the rear wall;

a top wall hinged to the rear wall;

said side walls and rear wall forming a display chamber;

an upper front wall hinged to the top wall;

an upper chamber wall located in the chamber and hinged to the upper front wall;

an upper chamber wall flap panel hinged to the upper chamber wall at opposite edges of the upper chamber wall and juxtaposed between a side wall outer panel and an inner panel;

a bottom wall hinged to the rear wall;

a lower front wall hinged to the bottom wall;

a lower shelf hinged to lower front wall and forming a bottom wall of the chamber;

at least one further shelf secured to said side walls in said chamber, said one further shelf having opposite lateral side edges, a flap extending from each lateral side edge and positioned between a side wall outer panel and at least one side wall inner panel; and a plurality of tab means for securing a plurality of the side wall inner panels to the rear wall and the lower shelf to the rear wall.

21. A collapsible paperboard article display comprising:

a rear wall;

first and second side walls each hinged to the rear wall, each side wall comprising an outer panel and a plurality of inner panels, the inner panels hinged to the outer panels distal the rear wall;

a top wall hinged to the rear wall;

said side walls and rear wall forming a display chamber;

an upper front wall hinged to the top wall;

an upper chamber wall located in the chamber and hinged to the upper front wall;

an upper chamber wall flap panel hinged to the upper chamber wall at opposite edges of the upper chamber wall and juxtaposed between a side wall outer panel and an inner panel;

a bottom wall hinged to the rear wall;

a lower front wall hinged to the bottom wall;

a lower shelf hinged to lower front wall and forming a bottom wall of the chamber; and at least one further shelf secured to said side walls in said chamber, said one further shelf having opposite lateral side edges, a flap extending from each lateral side edge and positioned between a side wall outer panel and at least one side wall inner panel;

each side wall having a first upper flap panel juxtaposed with the top wall in the chamber and a second upper flap panel juxtaposed with the upper front wall in the chamber.

22. A collapsible paperboard article display comprising:

a rear wall;

first and second side walls each hinged to the rear wall, each side wall comprising an outer panel and a plurality of inner panels, the inner panels hinged to the outer panels distal the rear wall;

a top wall hinged to the rear wall;

said side walls and rear wall forming a display chamber;

an upper front wall hinged to the top wall;

an upper chamber wall located in the chamber and hinged to the upper front wall;

an upper chamber wall flap panel hinged to the upper chamber wall at opposite edges of the upper chamber wall and juxtaposed between a side wall outer panel and an inner panel;

a bottom wall hinged to the rear wall;

a lower front wall hinged to the bottom wall;

a lower shelf hinged to lower front wall and forming a bottom wall of the chamber; and a plurality of further shelves secured to said side walls in said chamber, said shelves having opposite lateral side edges, a flap extending from each lateral side edge and positioned between a side wall outer panel and at least one side wall inner panel;

each further shelf comprising upper and lower juxtaposed panels hinged at a shelf front edge distal the rear wall, each shelf panel having said flap.

* * * * *